US006935330B1

(12) United States Patent
Barrero et al.

(10) Patent No.: US 6,935,330 B1
(45) Date of Patent: Aug. 30, 2005

(54) COOKING GRATE WITH REMOVABLE CENTRAL WOK RING

(75) Inventors: David Ricardo Barrero, Luvinate (IT); Mark W. Baldwin, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/366,110

(22) Filed: Feb. 13, 2003

(51) Int. Cl.[7] ..... F24C 15/22; F24C 15/06
(52) U.S. Cl. ..... 126/215; 126/214 C
(58) Field of Search ..... 126/215, 214 R, 126/214 C, 214 A, 9 R, 9 B, 25 R, 40, 50, 126/41 R, 38; D7/408, 409, 407; 219/432, 219/433, 458, 459; 248/346.01

(56) References Cited

U.S. PATENT DOCUMENTS

| | | | | |
|---|---|---|---|---|
| 730,268 | A * | 6/1903 | Keller | 126/39 H |
| 780,268 | A | 1/1905 | Curtiss | |
| 1,648,789 | A | 11/1927 | Stockstrom | |
| 4,435,638 | A | 3/1984 | Simon et al. | |
| 4,448,186 | A | 5/1984 | Smith | |
| 4,603,684 | A | 8/1986 | Kazuo et al. | |
| 4,607,613 | A | 8/1986 | Toldi | |
| 5,044,352 | A | 9/1991 | Lok | |
| 5,315,983 | A | 5/1994 | Law | |
| 5,345,062 | A | 9/1994 | Maudal | |
| 5,775,316 | A * | 7/1998 | Jones | 126/41 R |
| 6,588,417 | B2 * | 7/2003 | Jones et al. | 126/215 |
| 2004/0089288 | A1 | 5/2004 | Brown | |

FOREIGN PATENT DOCUMENTS

WO WO 02/066899 A1 9/2002

OTHER PUBLICATIONS

Fisher & Paykel Appliances, Inc.; "Cooktops;" Issue Date: Apr. 2001; Fisher & Paykel Appliances, Inc.; 27 Hubble, Irvine, California, 92618, USA; http://usa.fisherpaykel.com/CustomerCare/Brochures/pdfs/cooktopbroc.pdf.

* cited by examiner

*Primary Examiner*—Alfred Basichas
(74) *Attorney, Agent, or Firm*—John F. Colligan; Stephen Krefman; Robert O. Rice

(57) ABSTRACT

A grate system for a gas cooking appliance wherein the gas cooking appliance has a top panel having at least one burner extending up through the top panel. The grate system includes a grate element and a removable support ring supported on the grate element. The support ring includes a plurality of support posts extending outwardly from one side of the support ring. The support ring may be reversibly positioned between a first position and a second position. In the first position, the support ring provides a support surface generally in alignment with the grate element for supporting flat bottom cooking utensils. In the second position, the support elements extend upwardly for supporting a rounded bottom cooking utensil above the at least one burner element.

5 Claims, 7 Drawing Sheets

COOKING GRATE WITH REMOVABLE CENTRAL WOK RING

BACKGROUND OF THE INVENTION

1. Field of the Invention

This invention relates, generally, to cooking appliances and, more particularly, to a appliance having a grate which includes a removable central ring that allows use of a wok or curved bottom pan.

2. Description of Related Art

There are many cooking appliances known in the art which have top surfaces for cooking food items. These cooking appliances—commonly referred to as cooking ranges, cooking hobs, or merely cook-tops—are typically either electric or gas fired. Gas type cook-tops often include a top surface including a plurality of gas burners wherein a support structure or grate is provided for supporting cooking utensils above the burners. The grate disposed above a burner is conventionally designed to provide a flat support surface above the burner so that cooking vessels such as frying pans or sauce pans may be supported a preferred distance above the burner. Grate systems which provide a flat surface are ideal for flat bottom cooking vessels and allow pots and pans to slide freely across the grate.

The use of Asian woks for cooking food presents a problem for the conventional cooking appliances. A wok is a generally hemispheric or rounded bottom cooking vessel. The spherical bottom surface of a wok does not adapt well to the flat support surface of conventional cooking appliances.

To accommodate the use of a wok on a flat surface cooking appliances, an independent stand is often provided for holding the wok upright. These wok stands may consist of a cylinder or conical structure which rests on the cooking surface or grate system and supports the wok. U.S. Pat. No. 5,345,062 discloses various support stands for supporting an Asian wok on a flat surface Western kitchen range or cooking hob.

Another approach to allow use of a wok on a stove is to provide a burner well on the stove top. The burner well has an annular rim which can support a wok or other rounded bottom cooking vessels. U.S. Pat. No. 5,044,352 discloses such a large burner stove with recessed burner well.

While solutions have been proposed to allow the use of a wok with a conventional cooking appliance, none of these systems allow for quick and convenient conversion or adapting of the cooking appliance for use with flat bottom cooking utensil and, alternatively, for use with rounded bottom cooking utensils or woks.

SUMMARY OF THE INVENTION

The present invention is directed to a grate system for a gas cooking appliance wherein the gas cooking appliance has a top panel having at least one burner extending up through the top panel. A grate system is provided including a grate element and a removable support ring supported on the grate element. The support ring includes plurality of support posts extending outwardly from one side of the support ring. The support ring may be reversibly positioned between a first position and a second position. In the first position, the support ring provides a support surface generally in alignment with the top surface of the grate element for supporting flat bottom cooking utensils. In the second position the support elements extend upwardly for supporting a rounded bottom cooking utensil above the at least one burner element.

DESCRIPTION OF THE PREFERRED EMBODIMENTS

In the following description, the invention is described with reference to a particular embodiment of a gas cooking appliance—conventionally referred to as a gas cooktop or gas hob. However, it can be understood by one skilled in the art that the invention can be used with any type of cooking appliance employing a grate system supported above a burner and is not to be limited to the shown cooktop embodiment.

Figure 1:
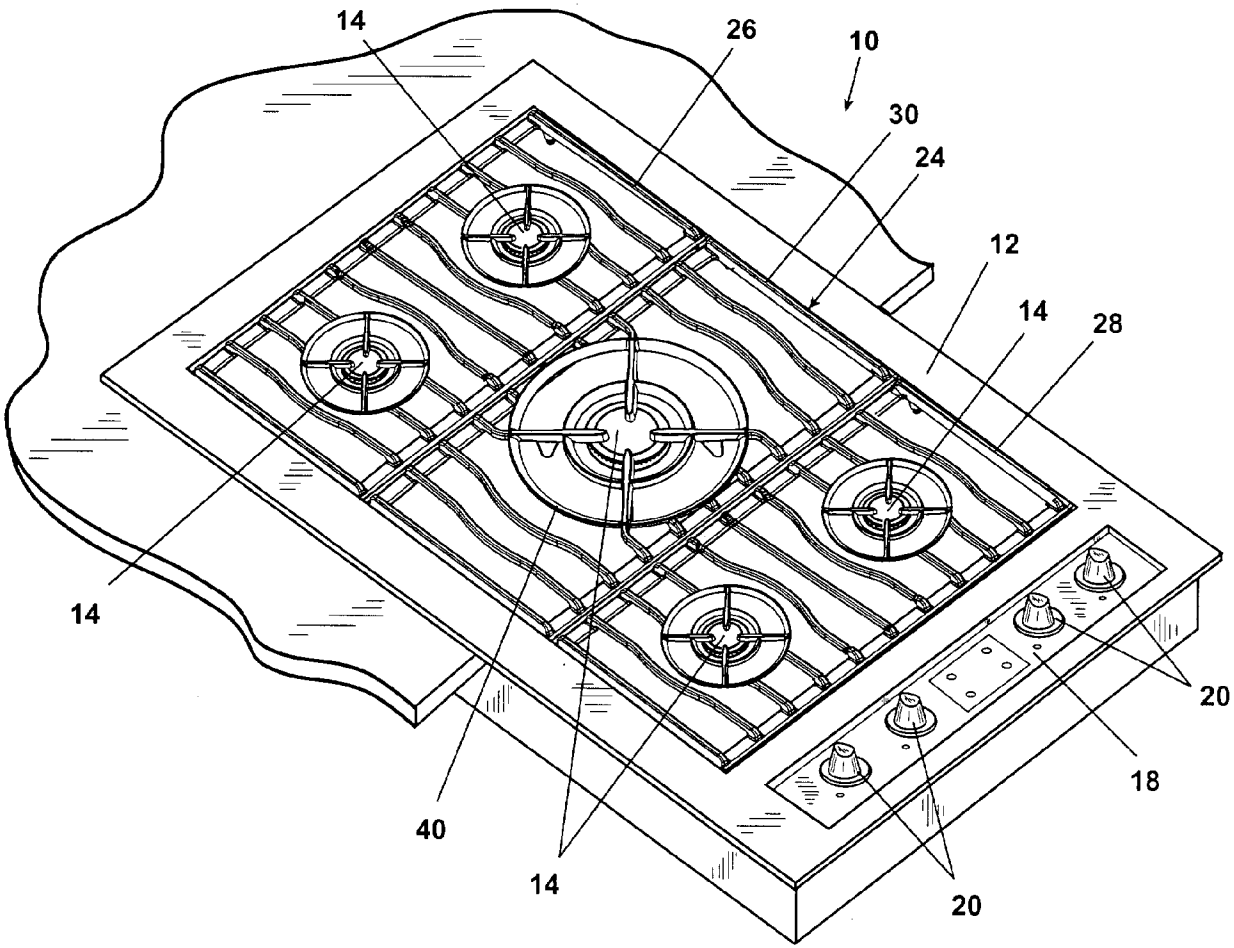
FIG. 1 is a perspective view of a gas cook-top embodying the present invention.

Referring to the drawings and in particular FIG. 1, wherein like reference numerals refer to like parts throughout the several views, a gas cook-top 10 is shown having a horizontal cooktop surface 12 which functions as the main top or top surface of the appliance. The cooktop surface 12 may be glass or sheet metal or other suitable materials. Extending up through the top surface 12 are a plurality of burners 14. The burners extend up through apertures (not shown) provided on the cooktop surface 12. A control panel 18 having a plurality of control knobs 20 is provided for igniting and regulating the gas flow to the burners 14.

A grate system 24 is used for supporting cooking utensils above the burners 14. The grate system 24 includes a plurality of grid or grate elements 26, 28 and 30 arranged adjacent to each other. Grate elements 26 and 28 are generally unitary parts and are formed from metal. The center grate element 30 includes a removable and reversible central wok or support ring 40 as described further herein. The grate elements 26, 28 and 30 are disposed above the cooktop surface 12 and, as shown in FIG. 1, may include feet 32 which rest on the cooktop. Alternatively, the grate elements may be supported from frame elements surrounding the cooktop surface 12 or in any other know manner.

Although the present description illustrates the present invention in a grate system which includes three grate elements. It can be understood by one skilled in the art that the present invention may be practiced on a cooking appliances with only one grate element or with any number of grate elements.

Figure 2:
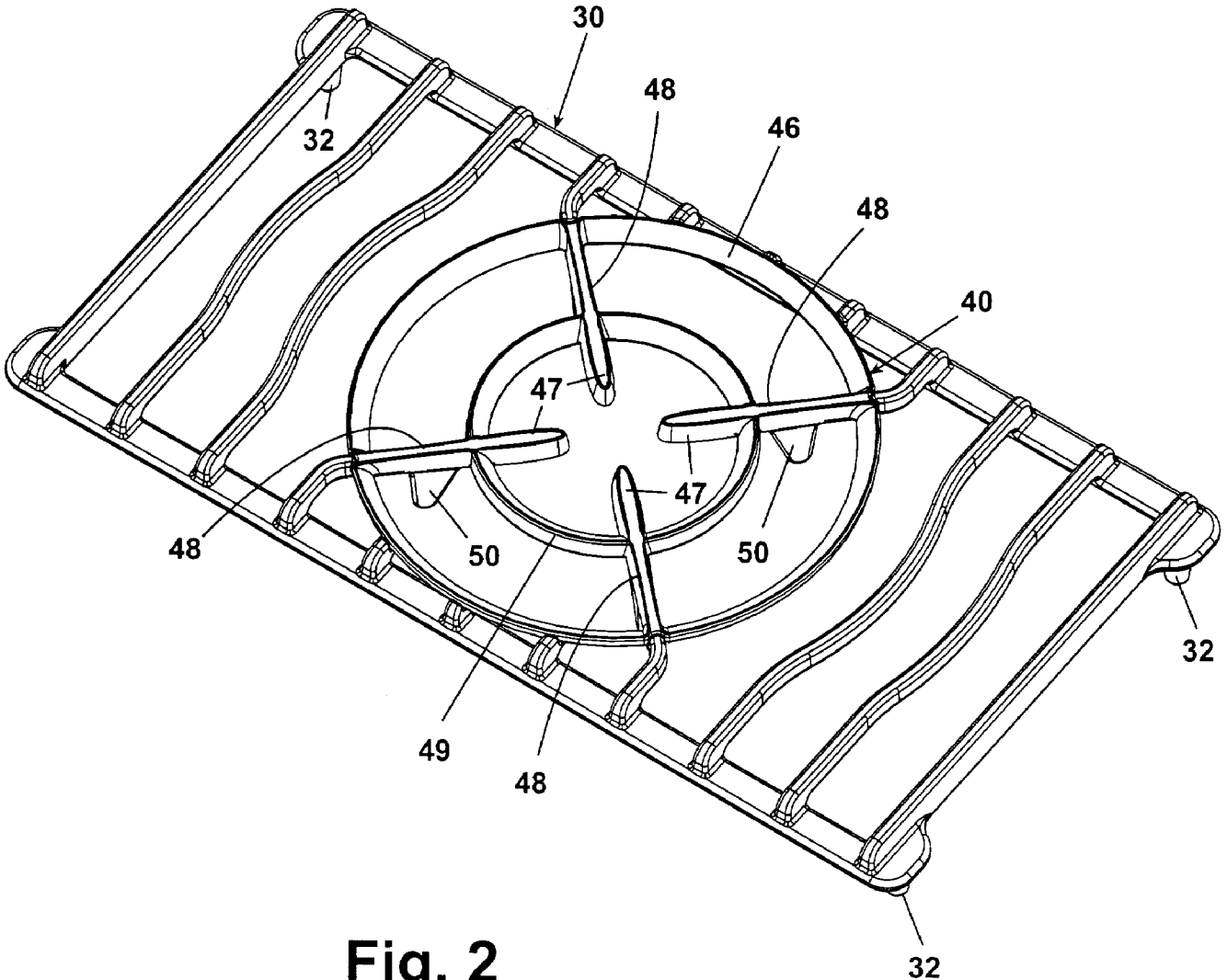
FIG. 2 is a perspective view of a grate element having a removable support ring.
Figure 3:
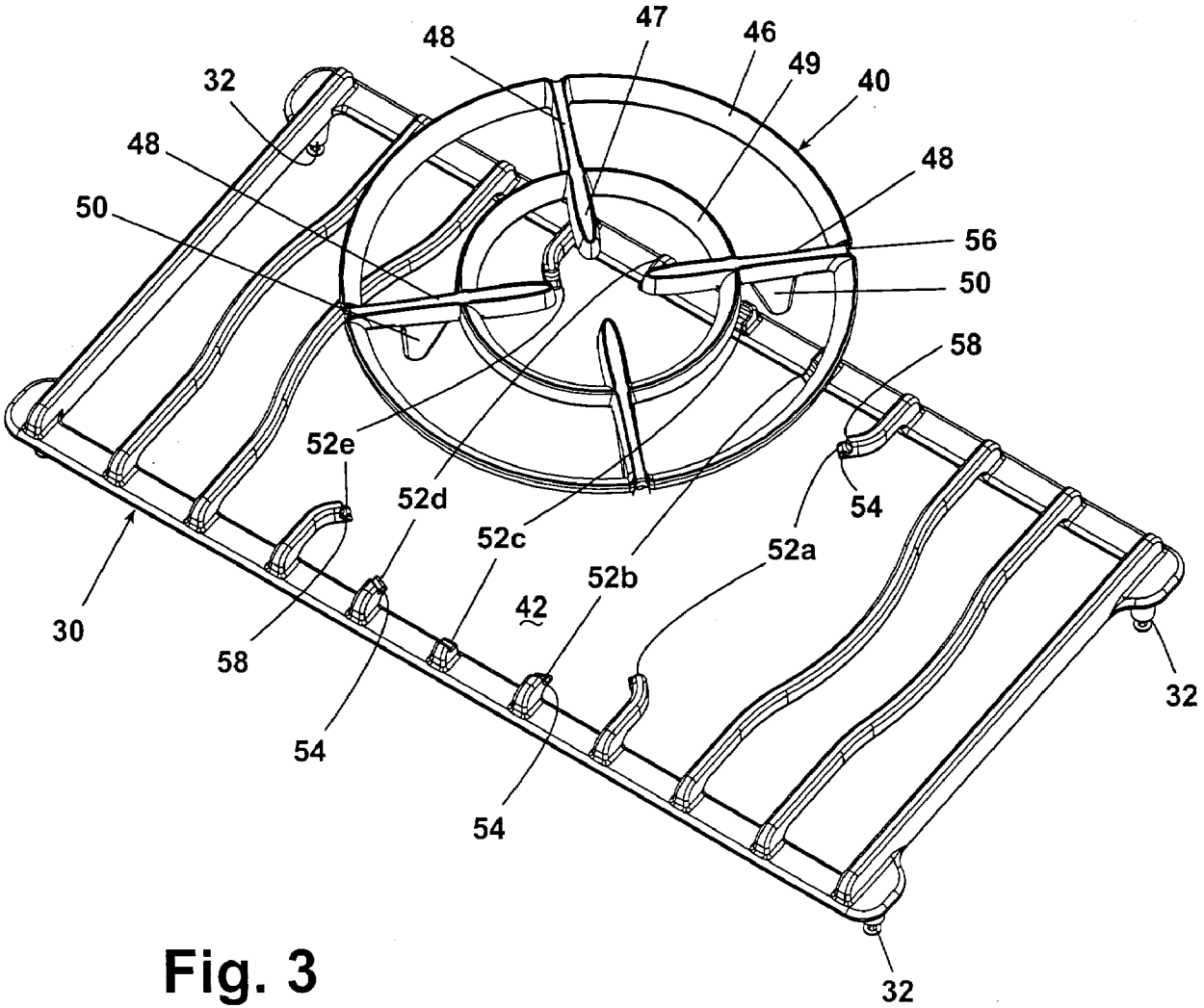
FIG. 3 is a perspective view of a grate element having a removable support ring, wherein the support ring is shown removed and reversed in position.
Figure 4:
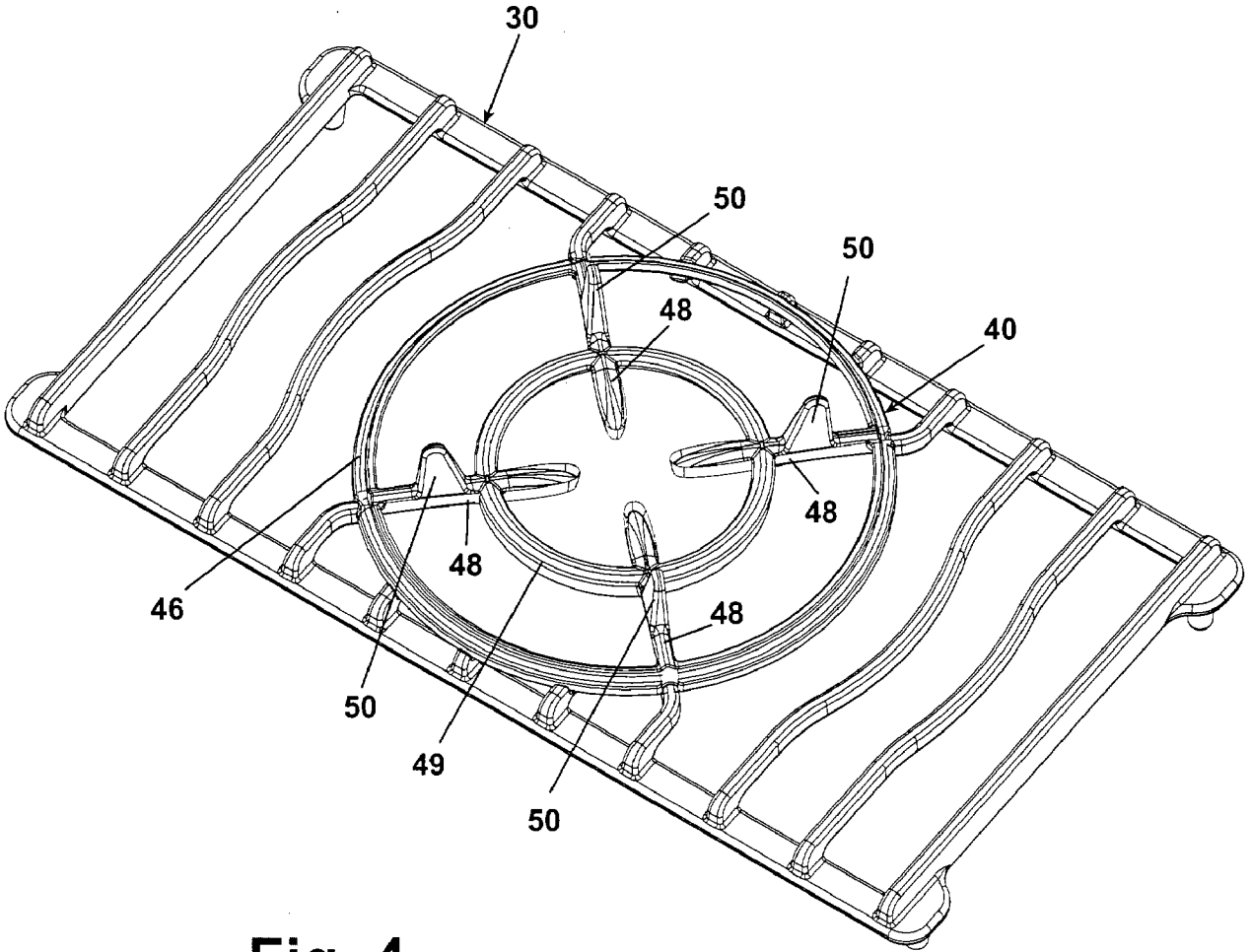
FIG. 4 is a perspective view of a grate element having a removable support ring, wherein the support ring is shown positioned on the grate element with the support posts extending upwardly.

Turning now to FIGS. 2–4 details of the support ring 40 can be understood. The support ring 40 is a removable part which can be used in two positions. The support ring 40 is supported within a opening 42 provided on the grate element 30. The opening 42 is positioned within the grate element 30 such that the opening 42 is generally aligned over a burner 14.

The support ring 40 includes a generally circular peripheral member 46 which defines a plane. A plurality of fingers 48 extend inwardly from the peripheral member 46 within the support ring plane and form a flat surface 47 on one side of the support ring 40. A second circular element 49 may be provided within the peripheral member 46. The support ring 40 further includes a plurality of support elements or posts 50 extending from one side of the peripheral member 46 generally perpendicular to the support ring plane for supporting a rounded bottom cooking utensil such as a wok.

The opening 42 is not provided with a rim but rather is defined by the termination or end points of a plurality of grate ribs 52*a*, 52*b*, 52*c*, 52*d* and 52*e*, defining the opening 42 which matches the shape of the support ring 40. A plurality of support surfaces 54 are formed into the termination or end points of the grate ribs 52*a*, 52*b*, 52*c*, 52*d* and 52*e*. Additionally, the support ring 40 includes a plurality of indentations 56 which correspond to protrusions 58 formed on at least one of the grate ribs thereby controlling the orientation of the support ring 40 in the grate member 30.

In a first position, shown in FIG. 2, the support ring 40 is positioned for normal use with a flat bottom cooking utensil. In this position, the support elements 50 are downwardly directed and the top surface 47 of the support ring 40 is generally aligned with the top surface of the grate element 30. The peripheral member 46 and the inwardly directed fingers 48 provide a support surface for flat bottomed cooking utensils positioned over the burner disposed under the support ring 40.

The support ring 40 can also be removed and reversed in position, as shown in FIG. 4, so that the support elements 50 extend upwardly. In this position, the support elements 50 are readily able to securely support a rounded bottom cooking utensil such as a wok.

Figure 5:
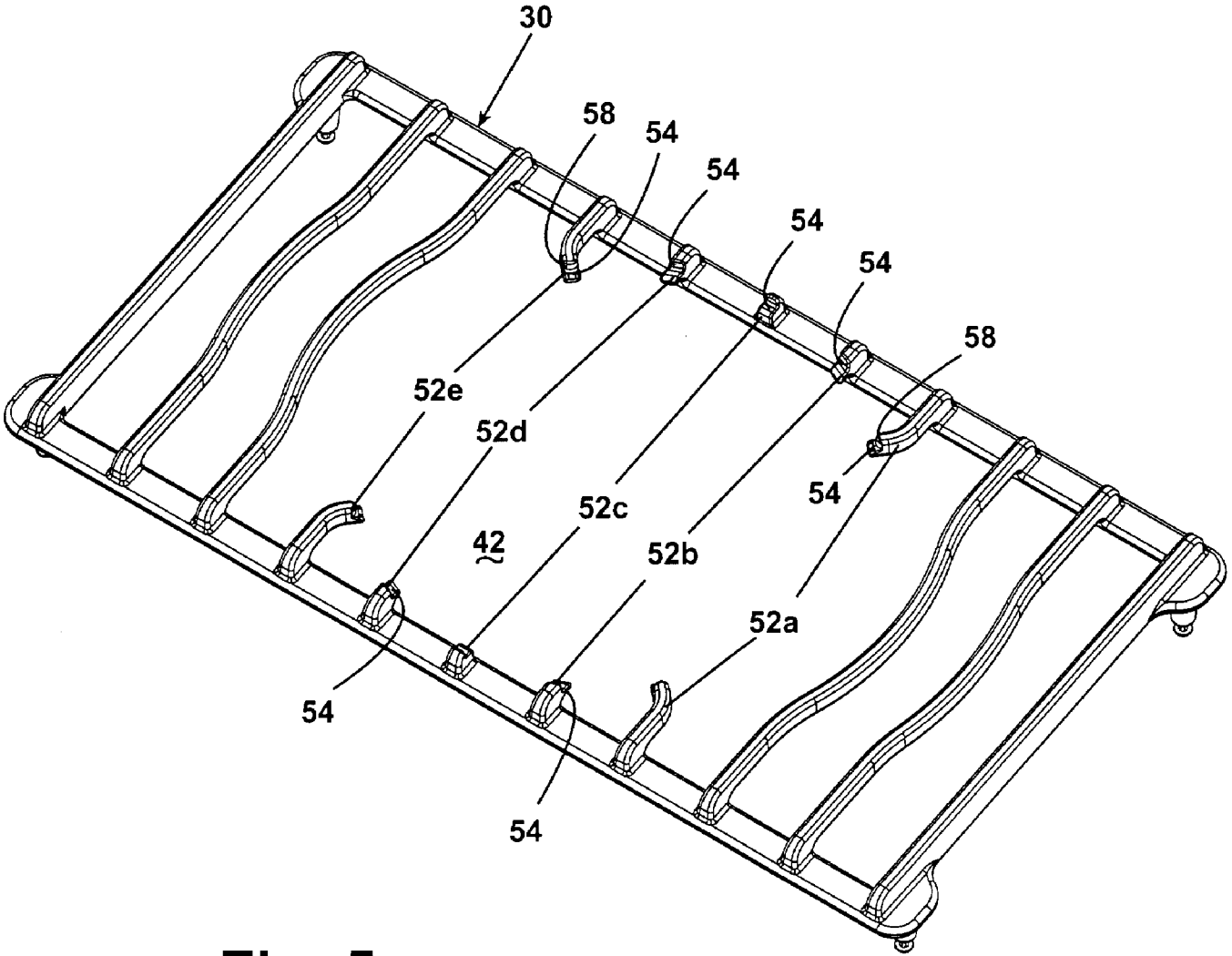
FIG. 5 is a perspective view of a grate element having a central opening and without the removable support ring.

Additionally, for very large rounded bottom cooking utensils, the support ring 40 can be removed entirely, as shown in FIG. 5. In this way, wok pans can be supported by the termination or end points of the grate ribs 52*a*, 52*b*, 52*c*, 52*d* and 52*e* above the burner disposed below the opening 42.

Figure 6:
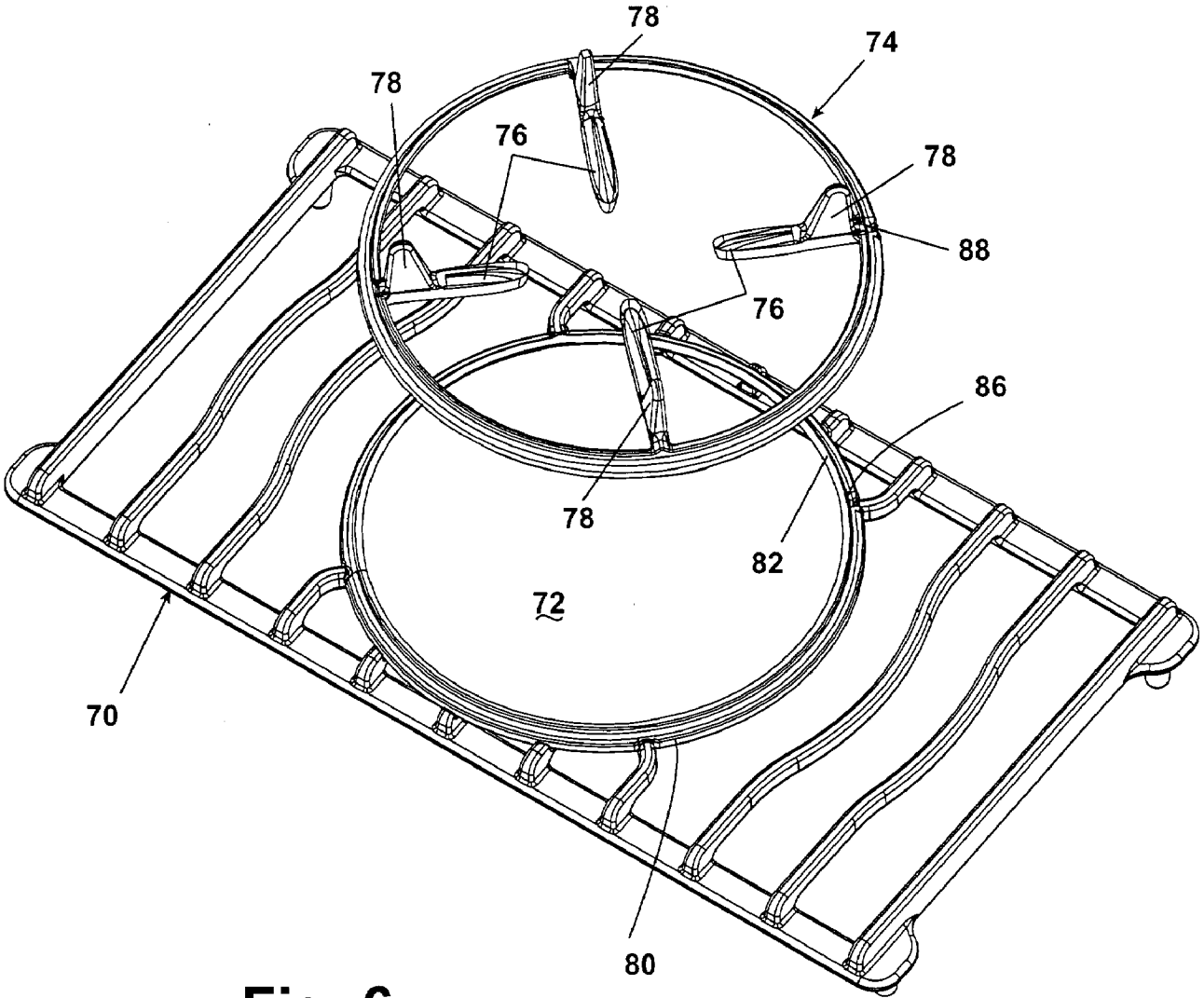
FIG. 6 is a second embodiment of the present invention, showing a perspective view of a grate element having a central opening with a peripheral rim.
Figure 7:
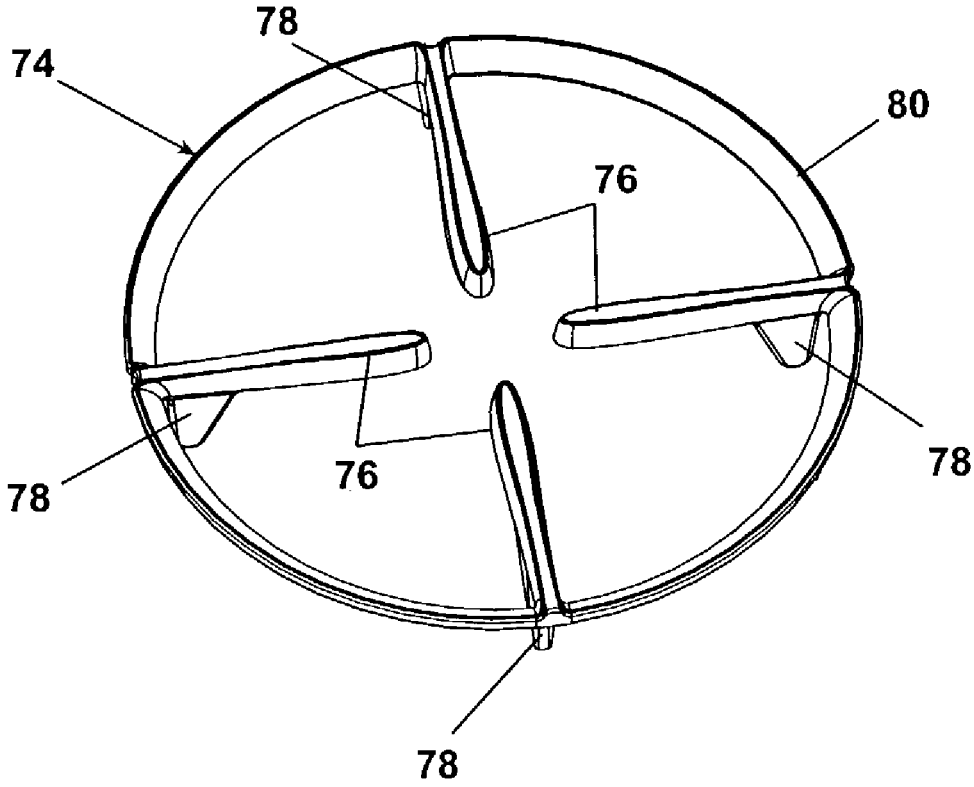
FIG. 7 is a second embodiment of the present invention, showing a perspective view of a removable support ring for use with the grate element of FIG. 6.

FIGS. 6 and 7 illustrate a second embodiment of the present invention wherein a grate member 70 is provided having an opening 72 for receiving a removable and reversible support ring 74. The support ring 74 includes a plurality of inwardly extending fingers 76 for forming a flat support surface on one side and a plurality of support elements 78 extending outwardly from the plane of the support ring 74 for supporting a rounded bottom cooking utensil such as a wok.

The opening 72 may be defined by a rim 80 which may be provided with an inwardly directly flange 82 for supporting the support ring 74. The flange 82 is offset from the top surface of the grate element 70 such that when the support ring 74 is seated on the flange 82 the top surface of the support ring 74 aligns with the top surface of the grate element 70. Additionally, the rim 80 can include at least one notch or slot 86 for aligning the support ring 74 by engaging a matching rib 88 on the support ring 74.

As in the first embodiment, the support ring 74 may be reversibly positioned on the grate element to support in one position flat bottom cooking utensils and in a second position rounded bottom cooking utensils.

While the support rings 40 and 74 shown in the above embodiments are generally circular, it can be understood that the support rings need not be circular but could be any convenient shape—including square, octagonal, trapezoidal or triangular. Moreover, while the above embodiments disclose grate elements 30 and 70 which include openings to receive support rings, the present invention can be practiced with grate elements that do not have openings to receive support rings but rather are formed with depressions or other structures to receive support rings.

This concludes the description of the preferred embodiments. A reading of it by those skilled in the art will bring to mind many alterations and modifications, in addition to those mentioned above, without departing from the spirit and scope of the invention. Therefore, it is intended that the invention be limited only by the appended claims.

We claim:

1. A cooking grate comprising:

a main support area for supporting a cooking utensil, the main support area comprising a peripheral frame and a plurality of support ribs extending from the peripheral frame toward an interior of the main support area;

a reversible insert removably mounted to the plurality of support ribs and reversible between first and second configurations, the insert comprising:

a first side for supporting a curved bottom cooking utensil about a first area when the insert is in the first configuration; and a second side for supporting a flat bottom cooking utensil when the insert is in the second configuration;

wherein the insert is selectively configurable between the first configuration and the second configuration by reversing the position of the insert within the main support.

2. The insert according to claim 1, wherein a curved bottom cooking utensil is supportable on the plurality of support ribs about a second area when the insert is removed from the main support.

3. The insert according to claim 2, wherein the second area is greater than the first area.

4. The insert according to claim 1, wherein the insert comprises multiple support elements that extend above the cooking grate to define the first area.

5. The insert according to claim 4, wherein the at least one support element comprises four support elements.

* * * * *